US009327887B2

(12) United States Patent
Farentinos et al.

(10) Patent No.: US 9,327,887 B2
(45) Date of Patent: May 3, 2016

(54) DELIVERY RECEPTACLE

(71) Applicant: ARCHITECTURAL MAILBOXES, LLC, Redondo Beach, CA (US)

(72) Inventors: Christopher Andrew Farentinos, Redondo Beach, CA (US); Vanessa Felicia Troyer-Farentinos, Redondo Beach, CA (US); Craig Ronald Steele, Hawthorne, CA (US); Raffy Michael Arce Paje, Redondo Beach, CA (US)

(73) Assignee: Architectural Mailboxes, LLC, Redondo Beach, CA (US)

( * ) Notice: Subject to any disclaimer, the term of this patent is extended or adjusted under 35 U.S.C. 154(b) by 0 days.

(21) Appl. No.: 14/773,159

(22) PCT Filed: May 5, 2014

(86) PCT No.: PCT/US2014/036866
§ 371 (c)(1),
(2) Date: Sep. 4, 2015

(87) PCT Pub. No.: WO2014/182636
PCT Pub. Date: Nov. 13, 2014

(65) Prior Publication Data

US 2016/0060008 A1 Mar. 3, 2016

Related U.S. Application Data

(60) Provisional application No. 61/819,953, filed on May 6, 2013.

(51) Int. Cl.
*B65D 55/14* (2006.01)
*A47G 29/14* (2006.01)

(Continued)

(52) U.S. Cl.
CPC ..... *B65D 55/14* (2013.01); *A47G 29/141* (2013.01); *B65D 43/16* (2013.01); *B65D 43/22* (2013.01);

(Continued)

(58) Field of Classification Search
CPC . A47G 29/122; A47G 29/124; A47G 29/141; A47G 29/148; A47G 29/20; A47G 29/30; A47G 2029/146; B65D 55/14; B65D 43/22; B65D 43/16; Y10T 70/7107; E05G 1/04; E05G 2700/02; E05B 49/002; E05B 37/0031; E05B 2047/0048; E05B 2047/0072
USPC ..... 70/63, 159–162, 279.1, 277, 278.7, 70/278.1, 278.3, 282; 109/59 R, 59 T, 66; 232/44, 45
See application file for complete search history.

(56) References Cited

U.S. PATENT DOCUMENTS 1,576,125 A 3/1926 Yeo
2,548,338 A 4/1951 Behrens (Continued)

FOREIGN PATENT DOCUMENTS

EP 0919167 A1 6/1999
FR 2732574 A1 10/1996

(Continued)

OTHER PUBLICATIONS

Extended European Search Report dated Nov. 26, 2015 in European Application No. EP 13 77 8338, Applicant: Architectural Mailboxes, LLC, (4pages).

(Continued)

*Primary Examiner* — Lloyd Gall
(74) *Attorney, Agent, or Firm* — Vista IP Law Group LLP

(57) ABSTRACT

A delivery receptacle for receiving objects (such as parcels, mail or other deliveries) deposited into the receptacle at residences or other building and locations, and securing the objects within the receptacle from unauthorized access. The receptacle has an input opening and a lid which can be moved between an open position which provides access to the input opening and a closed position which covers the input opening. The receptacle has a locking mechanism which may configured for any one of a plurality of operating modes, including a single-delivery mode which does not require an access code to the lid automatically locks after the delivery and a multi-delivery mode which requires the entry of a security code into a code-operated device to unlock the lid, open the lid, place the delivery into the receptacle, and close the lid which automatically locks closed.

21 Claims, 7 Drawing Sheets

(51) Int. Cl.

| | |
|---|---|
| ***B65D 43/16*** | (2006.01) |
| ***B65D 43/22*** | (2006.01) |
| ***E05B 37/00*** | (2006.01) |
| ***E05B 49/00*** | (2006.01) |
| *E05B 47/00* | (2006.01) |

(52) U.S. Cl.
CPC ..... *E05B 37/0031* (2013.01); *E05B 49/002* (2013.01); *A47G 2029/146* (2013.01); *E05B 2047/0048* (2013.01); *E05B 2047/0072* (2013.01); *Y10T 70/7107* (2015.04)

(56) References Cited

U.S. PATENT DOCUMENTS

| | | | |
|---|---|---|---|
| 2,563,150 | A | 8/1951 | Behrens |
| 3,519,198 | A | 7/1970 | Benoliel |
| 3,784,090 | A | 1/1974 | Markham |
| 4,753,387 | A | 6/1988 | Fee et al. |
| 4,754,126 | A | 6/1988 | Caldwell |
| 5,476,220 | A | 12/1995 | Cohoon |
| 5,818,336 | A | 10/1998 | Varga et al. |
| 5,841,361 | A | 11/1998 | Hoffman |
| 5,979,751 | A | 11/1999 | Maddox |
| 6,244,505 | B1 | 6/2001 | Grimes et al. |
| 6,347,737 | B1 | 2/2002 | Madruga |
| 7,158,941 | B1 | 1/2007 | Thompson |
| 7,246,738 | B2 | 7/2007 | Jonas |
| 7,249,705 | B2 | 7/2007 | Dudley |
| 7,337,944 | B2 | 3/2008 | Devar |
| 7,854,374 | B2 | 12/2010 | Dudley |
| 8,573,473 | B1 | 11/2013 | Farentinos et al. |
| 2001/0045449 | A1 | 11/2001 | Shannon |
| 2006/0169762 | A1 | 8/2006 | Irwin et al. |
| 2007/0181662 | A1 | 8/2007 | Satherblom et al. |
| 2008/0067227 | A1 | 3/2008 | Poss et al. |
| 2008/0121682 | A1 | 5/2008 | Grim et al. |
| 2009/0084836 | A1 | 4/2009 | Dudley |
| 2010/0006636 | A1 | 1/2010 | Frankenberg et al. |
| 2010/0127063 | A1 | 5/2010 | Bolles |
| 2011/0203328 | A1 | 8/2011 | Vilkomirski et al. |

FOREIGN PATENT DOCUMENTS

| | | | |
|---|---|---|---|
| GB | 149669 | A | 10/1921 |
| JP | 08-056812 | A | 3/1996 |
| JP | 2010-142406 | A | 7/2010 |
| WO | WO 2008/059290 | A1 | 5/2008 |

OTHER PUBLICATIONS

PCT International Search Report for PCT/US2013/036651, Applicant: Architectural Mailboxes, LLC, Form PCT/ISA/210 and 220, dated Jul. 9, 2013 (7pages).

PCT Written Opinion of the International Search Authority for PCT/US2013/036651, Applicant: Architectural Mailboxes, LLC, Form PCT/ISA/237, dated Jul. 9, 2013 (7pages).

PCT International Preliminary Report on Patentability for PCT/US2013/036651, Applicant: Architectural Mailboxes, LLC, Form PCT/IB1237, dated Oct. 21, 2014 (8pages).

Non-Final Office Action dated Jan. 5, 2015 in U.S. Appl. No. 14/511,063, filed Oct. 9, 2014, Inventor: Christopher Andrew Farentinos, (6pages).

Notice of Allowance dated Feb. 26, 2016 in U.S. Appl. No. 14/511,063, filed Oct. 9, 2014, Inventor: Christopher Andrew Farentinos, (10pages).

Patent Examination Report No. 1 dated Jan. 18, 2016 issued by Australian Government IP Australia in Australian Patent Application No. 2014262895, Applicant(s): Architectural Mailboxes, LLC (7pages).

PCT International Search Report for PCT/US2014/036866, Applicant: Architectural Mailboxes LLC, Form PCT/ISA/210 and 220, dated Sep. 15, 2014 (6pages).

PCT Written Opinion of the International Search Authority for PCT/US2014/036866, Applicant: Architectural Mailboxes LLC, Form PCT/ISA/237, dated Sep. 15, 2014 (12pages).

PCT International Preliminary Report on Patentability (Chapter II of the Patent Cooperation Treaty) for PCT/US2014/036866, Applicant: Architectural Mailboxes LLC, Form PCT/IPEA/416 and 409 (13pages), dated Jul. 8, 2015 (13pages).

DELIVERY RECEPTACLE

CROSS-REFERENCE TO RELATED APPLICATIONS

This Application is a U.S. National Stage filing under 35 U.S.C. 371 of PCT Patent Application No. PCT/US2014/036866, filed May 5, 2014, which claims priority to U.S. Provisional Patent Application No. 61/819,953, filed May 6, 2013. The contents of the aforementioned applications are incorporated by reference herein. Priority is expressly claimed in accordance with 35 U.S.C. 119, 120, 365 and 371 and any other applicable statutes.

BACKGROUND

The field of the invention generally relates to receptacles for receiving objects while preventing unauthorized access to the received objects, and more specifically to delivery receptacles for receiving parcels and packages such as from delivery services, such as the United States Postal Service (USPS), Federal Express, United Parcel Service (UPS), or other private carriers and delivery services, and the like.

A variety of delivery receptacles have been previously provided, including some having devices for restricting access to parcels deposited into the receptacle to prevent theft or vandalism. For example, U.S. Pat. No. 2,563,150, issued to H. C. Behrens, discloses a an anti-theft rotary drum night depository receptacle. The receptacle has a rotatable cylindrical drum for receiving parcels. The drum is rotated by pulling a knob outwardly, which actuates a rack and pinion operatively connected to the drum. As another example. U.S. Pat. No. 3,784,090, issued to Markham, discloses a safe deposit apparatus having a rotary drum. The drum is actuated by opening a door which is operatively coupled to the drum by mating gears.

Several other representative examples of parcel receptacles with access restricting devices are shown in U.S. Pat. No. 7,246,738 to Jonas; U.S. Pat. No. 7,158,941 to Thompson; and U.S. Pat. No. 6,244,505 to Grimes, which provide further background for the present.

SUMMARY

The present invention is directed to an innovative delivery receptacle for receiving objects (such as parcels, mail or other deliveries) deposited into the receptacle at residences or other building and locations, and securing the objects within the receptacle from unauthorized access. The receptacle has an input opening and a lid which can be moved between an open position which provides access to the input opening and a closed position which covers the input opening. The lid and opening can be located at any suitable location of the receptacle, including the top or side (typically near the top). The receptacle utilizes an innovative locking mechanism which may allow for either single or multiple deliveries, depending on the chosen operating mode. In its simplest, single-delivery mode, a user need only open the unlocked lid, place the delivery into the receptacle, and close the lid which automatically locks closed, to securely make a single delivery. In a flexible, multi-delivery mode, the user need only enter a code into a code-operated device of the locking mechanism to unlock the lid, open the lid, place the delivery into the receptacle, and close the lid which automatically locks closed. The locking mechanism is configured to appropriately lock the lid in the closed position after the delivery is placed into the receptacle. Accordingly, the delivery receptacle provides a simple and secure means to receive deliveries, and protect them from theft and/or vandalism.

The delivery receptacle may be a self-standing device which sits on a floor surface, or it may be a table top, stand supported, or structure mounted device (such as a wall or other supporting structure). The delivery receptacle may be secured to the floor or a solid structure to prevent theft of the entire receptacle.

In one embodiment, the receptacle comprises a main housing which encloses a storage area for receiving objects inserted into the receptacle. The main housing has an input opening for receiving an object being deposited into the receptacle. The input opening adjoins the storage area. A lid for opening and closing the input opening is hingedly attached to the housing. The lid can be moved between a closed position in which the lid covers the input opening and prevents access to the storage area, and an open position in which the lid is substantially out of the way of the input opening to allow access to the storage area through the input opening.

The receptacle also has a locking mechanism having a latch, an actuation device, and a controller. The actuation device is operably coupled to the latch to move the latch between a locked position which locks the lid in the closed position, and an unlocked position in which the latch allows the lid to be opened from the closed position. The controller is operably coupled to the actuation device in order to control the operation of the actuation device, and in turn, the locking mechanism. The locking mechanism has a locked state in which the actuation device positions the latch in the locked position, and an unlocked state in which the actuation device position the latch in the unlocked position. The controller includes a code-operated device, such as an electronic combination keypad. The controller is configured such that when the appropriate code is entered into the code-operated device, the controller adjusts the locking mechanism from the locked state to unlocked state. In other words, the controller causes the actuation device to move the latch from the locked position to the unlocked position.

In order to provide the single-delivery operation as mentioned above, the locking mechanism is configured to operate in a first mode. In this first mode, the locking mechanism is initially in the unlocked state with the lid in the closed position. The lid is unlocked, so the lid may be opened by simply lifting the lid. Upon either opening the lid, or opening and closing the lid, the locking mechanism is adjusted from the unlocked state to the locked state such that when the lid is closed, the lid is locked in the closed position. In one aspect, in order to detect that the lid has been opened, a lid position sensor may be provided which is coupled to the controller and configured to signal the controller when the lid has been opened. For example, the lid position sensor may signal whether the lid is in the closed position or the open position, or simply when the lid has been moved from the closed position to the open position. After the lid has been locked in the closed position, the lid can be unlocked by entering the code into the code-operated device, thereby causing the controller to adjust the locking mechanism from the locked state to the unlocked state, allowing the lid to be opened. In another aspect, the locking mechanism may be adjusted from the unlocked to the locked state by a mechanical latch locking device which retains the latch in the unlocked position and releases the latch to the locked position upon opening the lid.

Thus, the first mode provides a very easy single-delivery operation as follows. A person making a delivery to the delivery receptacle simply opens the unlocked lid and deposits the delivery through the input opening into the storage area. Upon opening the lid (or opening and closing the lid, as the case may be), the locking mechanism is adjusted from the unlocked state to the locked state. Then, when the lid is closed, the lid is locked in the closed position, thereby securing the delivery within the receptacle. The owner of the receptacle may retrieve the delivery by entering the code into the code-operated device which causes the controller to adjust the locking mechanism from the locked state to the unlocked state, or by inserting a key into a key lock and turning the key lock to a key unlocked position as described below, allowing the lid to be re-opened.

This first mode may also allow multiple deliveries by providing the code to the delivery person(s). Upon each delivery, the delivery person enters the code into the code-operated device. Upon entering the code, the controller causes the locking mechanism to adjust to the unlocked state. The delivery person moves the lid to the open position and deposits the delivery into the storage area. Upon opening the lid (or opening and closing the lid, as the case may be), the locking mechanism is adjusted from the unlocked state to the locked state. Then, when the lid is closed, the lid is locked in the closed position, thereby securing the delivery within the receptacle. The multiple deliveries may be retrieved by entering the code into the code-operated device which causes the controller to adjust the locking mechanism from the locked state to the unlocked state, or by inserting a key into a key lock and turning the key lock to a key unlocked position as described below, allowing the lid to be re-opened.

In a further aspect of the delivery receptacle of the present invention, the locking mechanism may also have additional operating modes. For example, in a second mode, the locking mechanism is placed in the locked state and the locking mechanism cannot be adjusted from the locked state to the unlocked state by entering the code into the code-operated device. In other words, the code-operated device is locked out of operation. In the second mode, the locking mechanism can only be unlocked to open the lid by using an alternative means, such as a key lock, as described below.

Furthermore, in a third mode, the locking mechanism is adjusted into the unlocked state, and the locking mechanism is not adjusted to the locked state upon opening the lid (or upon opening and closing the lid), such that the lid can be opened and closed and opened again without entering the code.

In another aspect, the delivery receptacle and/or locking mechanism may be configured to operate in at least two of the three operating modes described above, such as the first mode and second, mode, first mode and third mode, second mode and third mode, or first mode, second mode and third mode.

The delivery receptacle may have a mode selection switch operably coupled to the controller. The mode selection switch has a switch position for each operating mode, as described above. For instance, if the receptacle has three modes, the mode selection switch has three positions, one for each mode. The user may set the mode selection switch to the desired mode, and the controller detects the mode selected on the mode selection switch, and operates according to the selected mode.

In another aspect of the present invention, a manually operated override lock is disposed in the housing. The override lock is configured to be operated manually and has a latch adjusting mechanism such that manually operating the lock adjusts the latch adjusting mechanism between an override locked position in which the latch adjusting mechanism does not affect the locking mechanism and an override unlocked position in which the latch adjusting mechanism adjusts the locking mechanism to the unlocked position.

The override lock may be further configured such that when it is in the override unlocked position the override lock allows access to a programming button for putting the controller into a programming mode, and in the override locked position the override lock prevents access to a programming button for putting the controller into a programming mode.

The override lock may also have a locking device for locking an access door to a utility compartment. The override locking device is adjusted when the override lock is operated, such that when the override lock is in the override locked position the door locking device is in a door locked position which locks the access door in a closed position preventing access into the utility compartment and when the override lock is in the override unlocked position the door locking device is in a door unlocked position which unlocks the access door allowing the door to be opened thereby allowing access into the utility compartment.

In a further aspect of the invention, the override lock may be a key lock disposed in the housing which is operated by a key. The key lock has a latch cam (latch adjusting mechanism) which can adjust the locking mechanism when the key is rotated to rotate the key lock and latch cam. Rotating a key in the key lock rotates the key lock and latch cam between a key locked position in which the latch cam does not affect the state of the locking mechanism and a key unlocked position in which the latch cam adjusts the locking mechanism to the unlocked state. The key lock allows the owner or other authorized person to open the lid of the receptacle without entering the code into the code-operated device.

In still another aspect, the actuation device may be any suitable mechanism which can adjust the latch between the open position and closed position, including without limitation, an electric motor, or an electric solenoid. The electric motor or electric solenoid is mechanically coupled to the latch. The actuation device may further comprise a spring to provide a biasing force on the latch.

In one embodiment, the delivery receptacle is configured as a mail parcel receptacle and is designed to receive relatively large objects, such as a package that will within a rectangular box having approximate dimensions of 11.5"× 12.5"×23", or larger.

DETAILED DESCRIPTION

Figure 1:
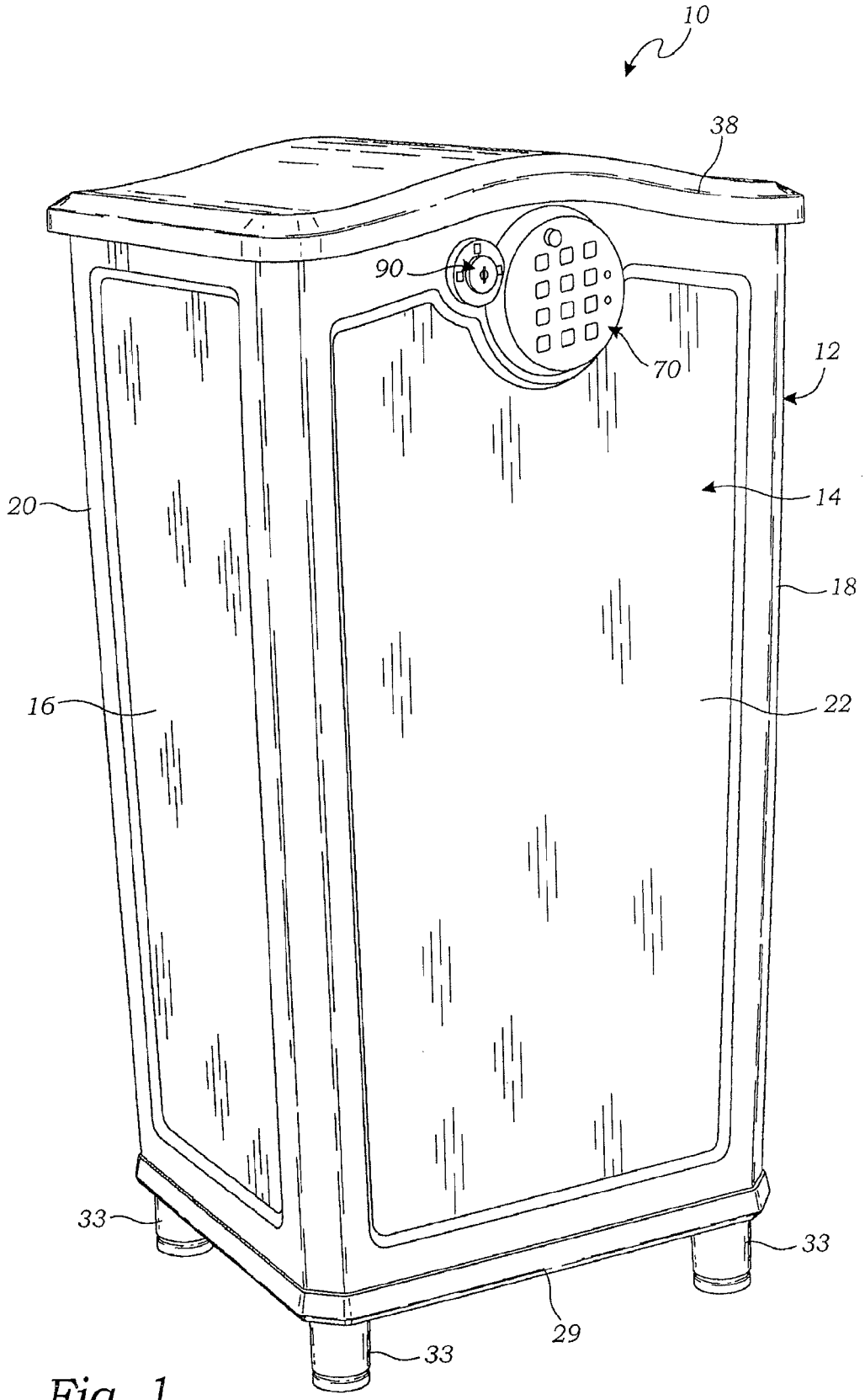
FIG. 1 is a front perspective, view of a delivery receptacle with the delivery door in the closed position, according to one embodiment of the present invention.

Turning first to FIGS. 1-6, one embodiment of a delivery receptacle 10 according to the present invention is shown. The receptacle 10 comprises a housing 12 that generally forms the enclosure for the receptacle 10. The housing 12 may have a frame (not shown) and one or more walls that form a housing cover 14. For example, the housing cover 14 of the receptacle 10 may include a first sidewall 16, a second sidewall 18, a back wall 20, a front wall 22, and a bottom wall 24. The first sidewall 16, second sidewall 18, back wall 20, and front wall 22 may taper slightly from top to bottom of the housing 12 such that the cross-section of the top of the receptacle 10 is slightly larger than the cross-section of the bottom of the receptacle 10. The taper helps keep objects placed in the receptacle from becoming stuck by being jammed between two or more of the walls. The first sidewall 16, a second sidewall 18, a back wall 20, a front wall 22, and a bottom wall 24 form a storage area 26 within the housing. The housing 12 has an input opening 28 at the top of the housing 12 which adjoins the storage area 26. The input opening 28 receives objects being deposited into the storage area 26 of the receptacle 10.

Figure 12:
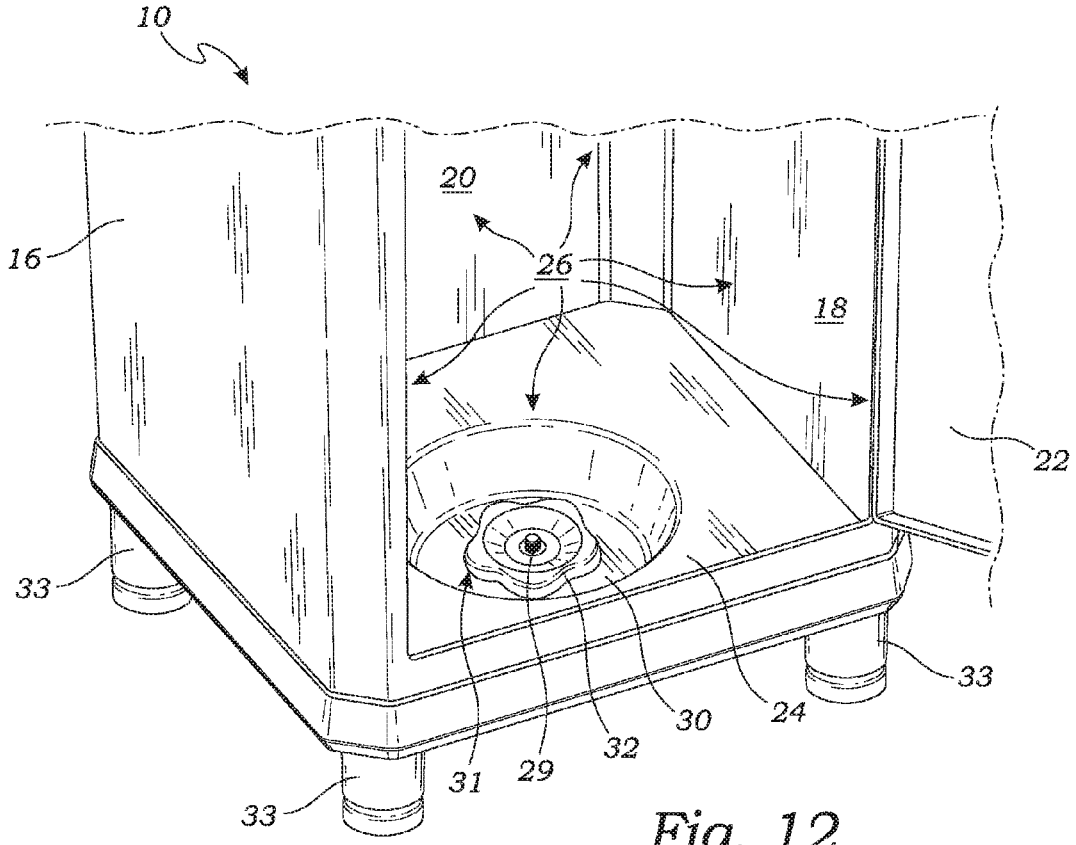
FIG. 12 is an enlarged, partial front view of the delivery receptacle according to the embodiment of FIG. 1 and the second embodiment, with the front panel removed to show the storage area, the housing bottom and mounting bolt.

Turning briefly to FIG. 12, the bottom wall 24 may have one or more drainage holes to drain fluid, such as rain, that enters the housing 12. The bottom wall 24 may also have a floor contour that facilitates water flow out through the drain holes. A small basin or collection area 30 may be included, such as in the location of the nut 32, to collect small amounts of water and keep the water away from delivered articles in the storage compartment 30. The bottom wall 24 may also have ribs or striations that raise a pad off the bottom wall 24 to help air flow in damp environments. The receptacle 10 also has a plurality of legs 33 (in this case 4 legs) extending from the bottom wall 24 of the housing 12. The legs 33 may have alternative heights and styles for different ground types and surfaces. The legs 33 may also be fixed, removable and/or adjustable (e.g. adjustable height).

The receptacle 10 has a ground anchor assembly 31 for securing the receptacle 10 to the ground or other stationary object, such as a structural wall, etc. The ground anchor assembly 31 comprises a mounting bolt 29 which extends through a hole in the bottom wall 24 of the housing 12. A hand-tighten nut 32 threads onto the first end of the mounting bolt 29 to secure the ground anchor assembly 31 to the receptacle 10. One or more mounting bracket(s) may be provide which thread onto the second end of the mounting bolt 29 and has a device for securing the anchor assembly 31 to the ground or other secured structure or wall.

Figure 2:
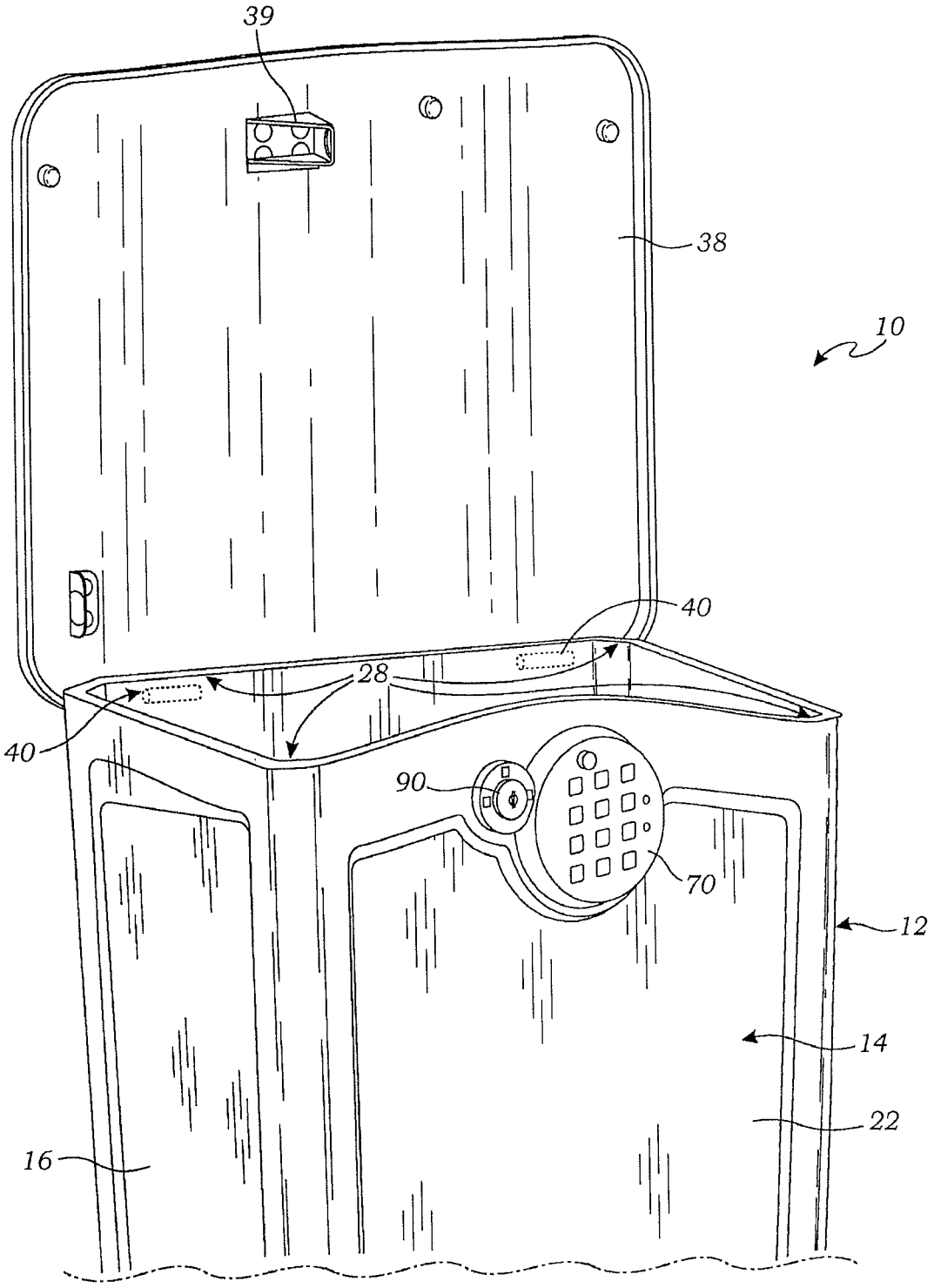
FIG. 2 is a front perspective, view of the delivery receptacle of FIG. 1, with the delivery door in the open position.
Figure 3:
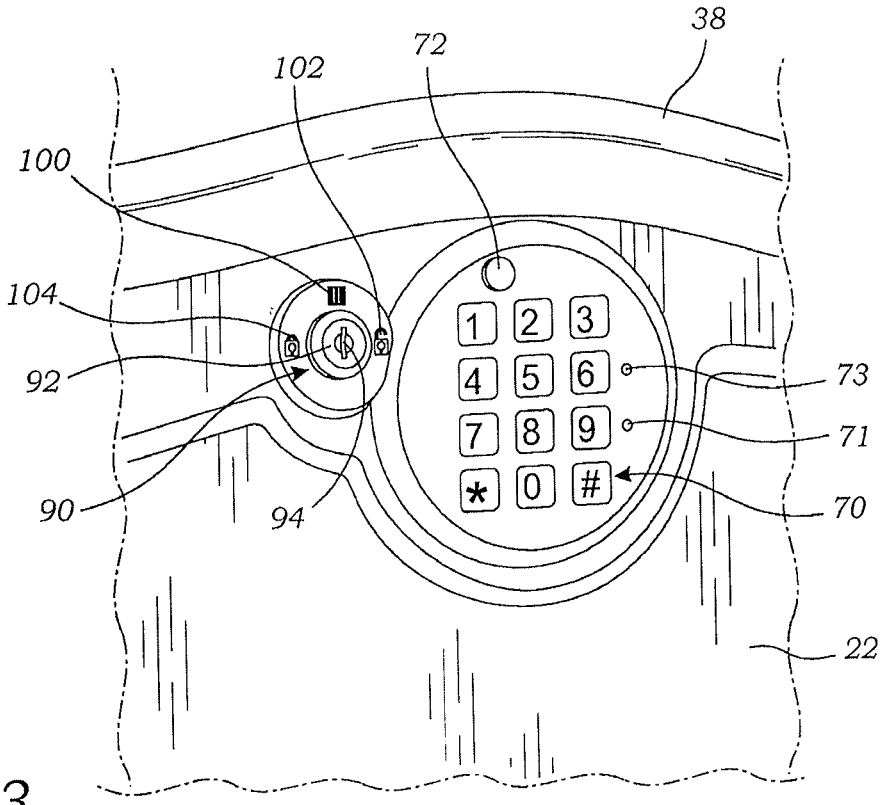
FIG. 3 is an enlarged partial front view of the delivery receptacle of FIG. 1, showing the electronic keypad and key lock.

A lid 38 is hingedly attached to the housing 12 for opening and closing the input opening 28. The lid 38 is attached to the top portion of the back wall 20 of the housing 12 using one or more hinges 40. Alternatively, the lid 38 may be attached to a top portion of any one of the first side wall 16, second side wall 18, or front sidewall 22, using one or more hinges. The lid 38 may be pivoted about the hinges 40 from a closed position as shown in FIG. 1 to an open position as shown in FIG. 2. In the closed position, the lid 38 completely covers the input opening 28 and prevents access to the storage area 26. In the open position, the lid 38 is completely or substantially completely out of the way of the input opening 28 and a vertical extension of the input opening 28 to allow convenient access to the storage area 26 through the input opening 28.

Figure 4:
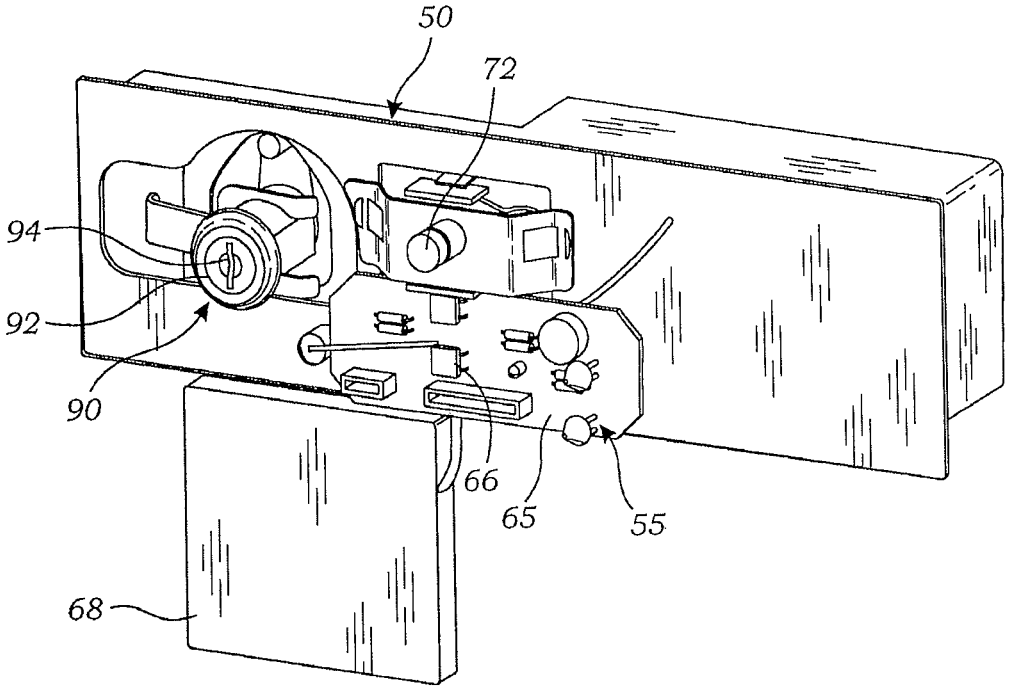
FIG. 4 is an enlarged, front view of the locking mechanism, key lock, utility compartment and other components of the delivery receptacle of FIG. 1.
Figure 5:
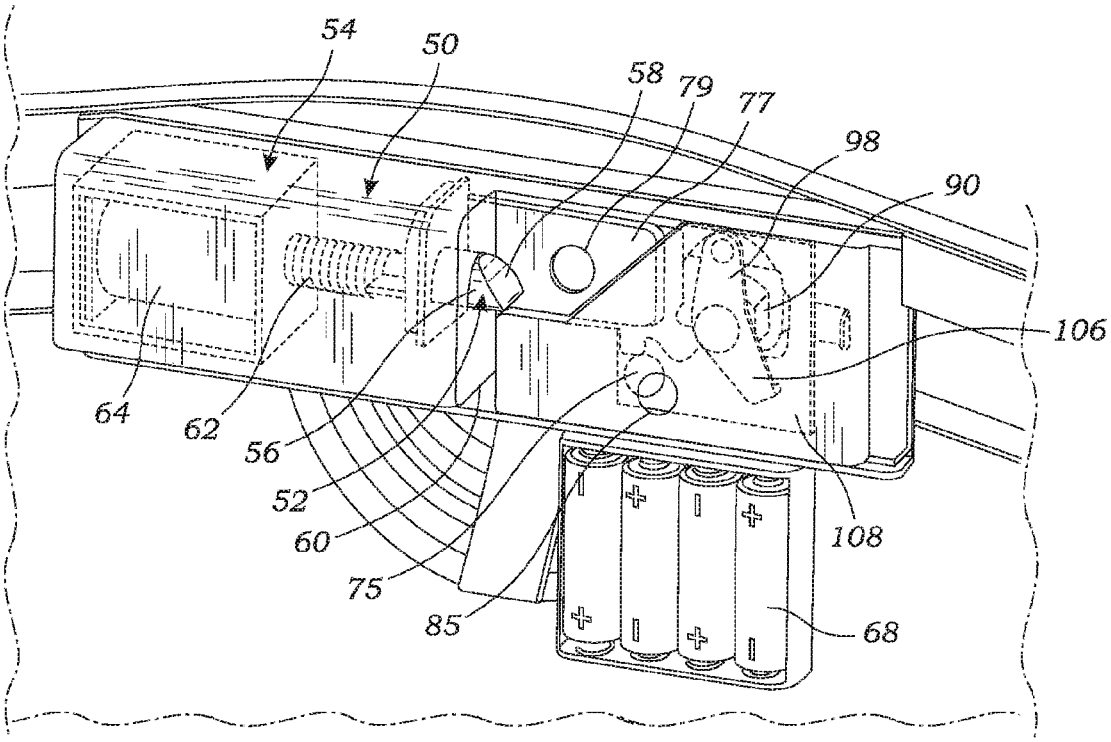
FIG. 5 is an enlarged, back view of the locking mechanism, key lock, utility compartment and other components of the delivery receptacle of FIG. 1.
Figure 6:
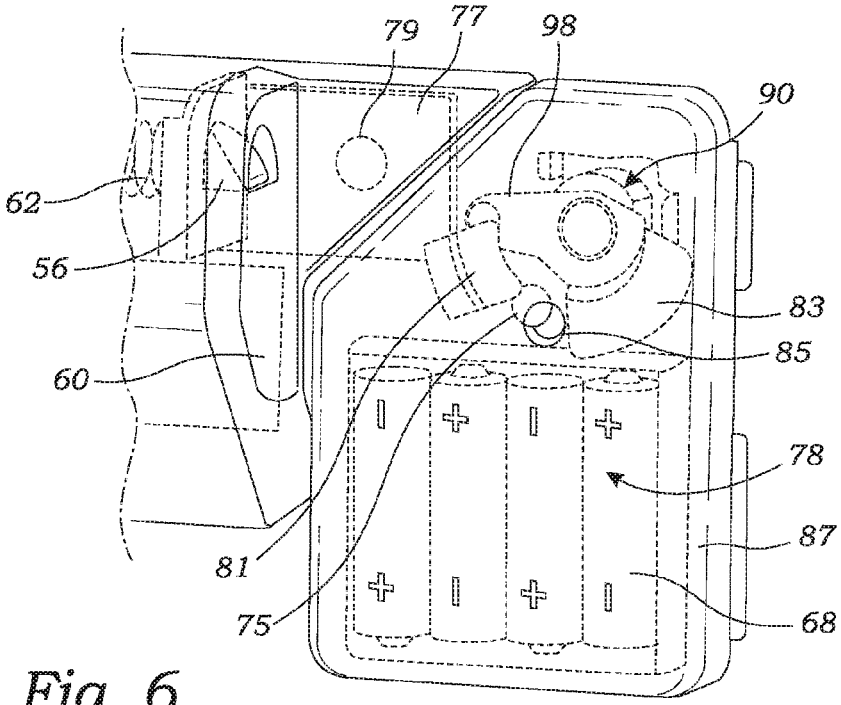
FIG. 6 is an enlarged view of the utility compartment of the delivery receptacle of FIG. 1, with the utility cover installed.
Figure 7:
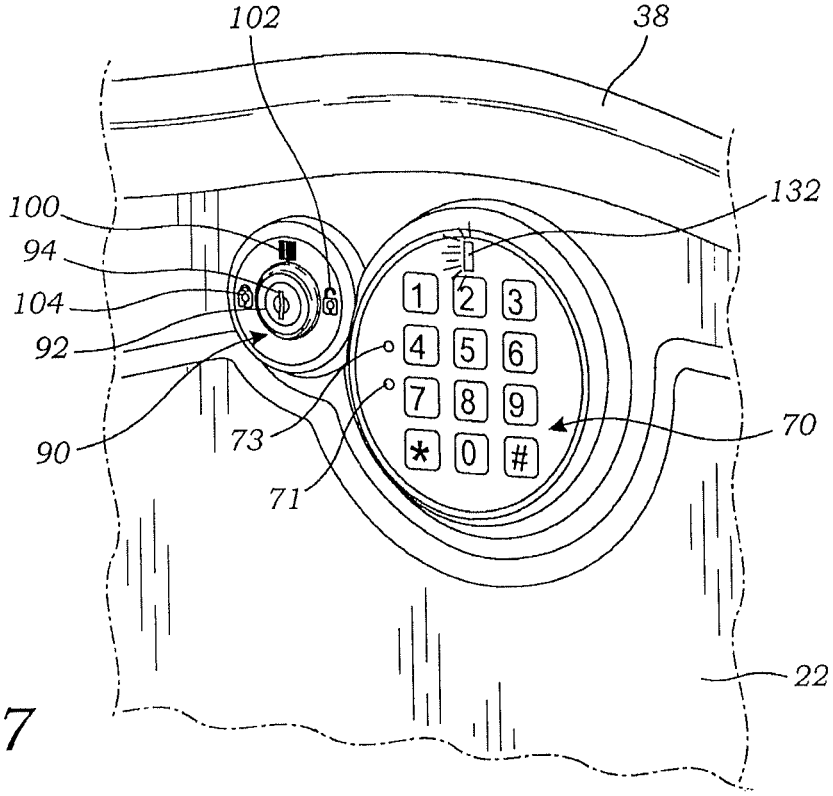
FIG. 7 is an enlarged partial front view of an alternative electronic keypad according to a second embodiment of the delivery receptacle of FIG. 1, with the indicator flag in the "out" position.
Figure 8:
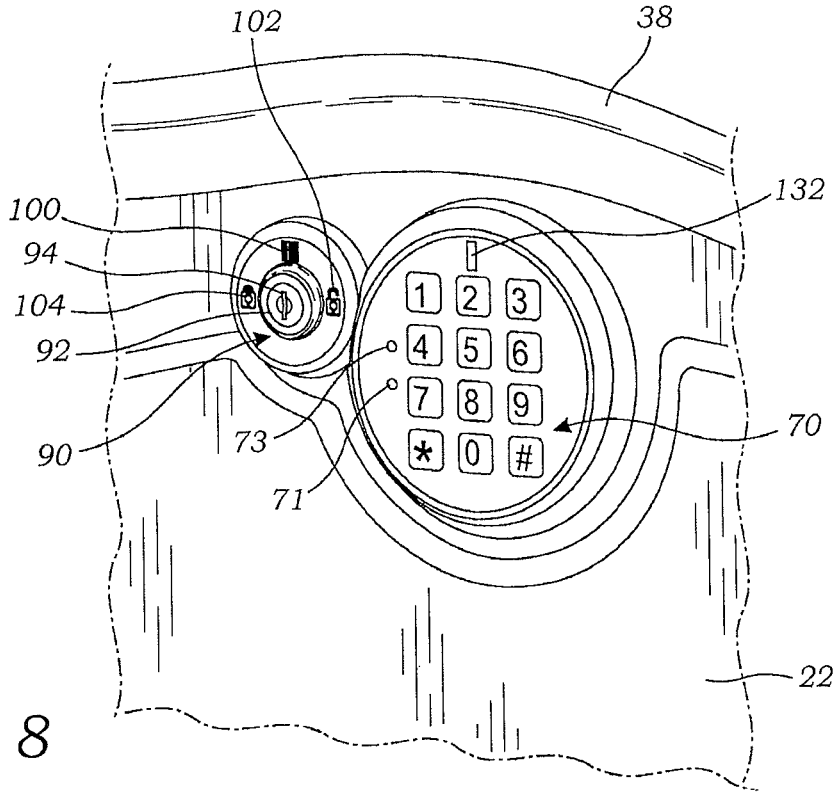
FIG. 8 is an enlarged partial front view of the alternative electronic keypad of FIG. 7 with the indicator flag in the "in" position.
Figure 9:
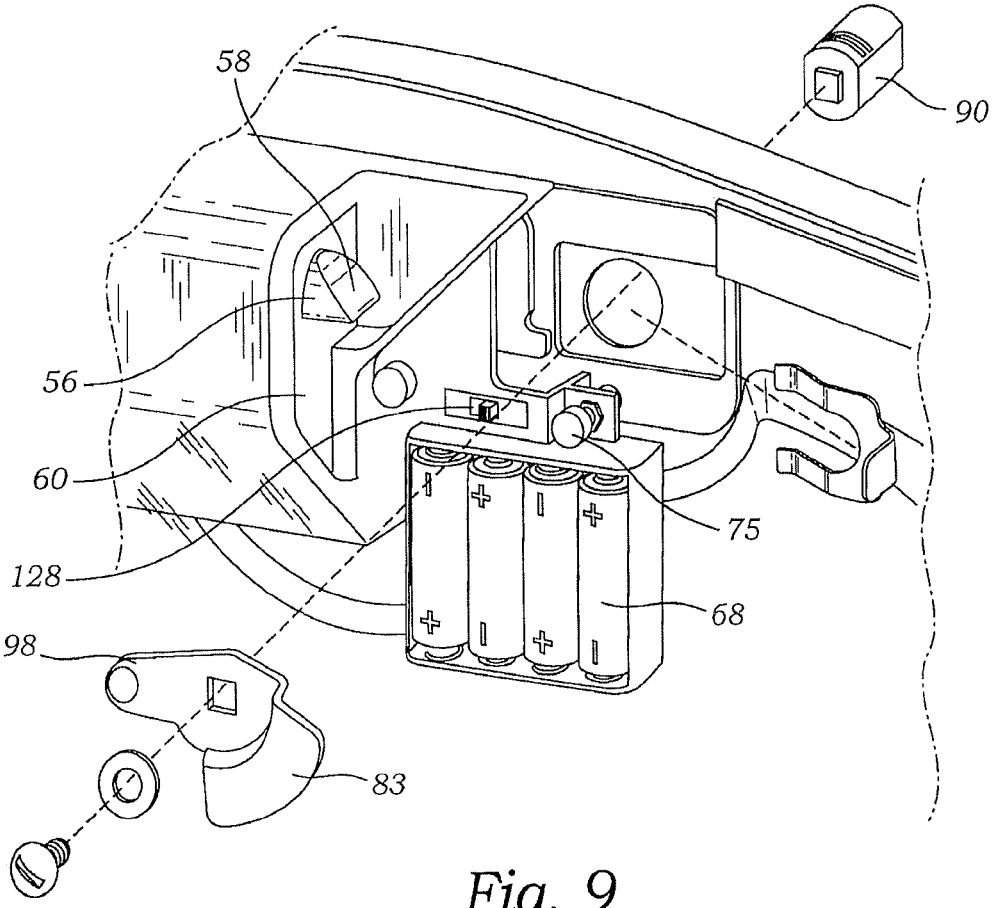
FIG. 9 is an enlarged rear view of an alternative locking mechanism, key lock, utility compartment and other components, according to the second embodiment of the delivery receptacle of FIG. 1.

The receptacle 10 has a locking mechanism 50 for locking the lid 38 in the closed position and unlocking the lid 38 to allow it to be opened to the open position. One embodiment of the locking mechanism 50 is shown in FIGS. 4-6. The locking mechanism 50 comprises a latch assembly 52, an actuation device 54, and an electronic controller 55. The latch assembly 52 includes a latch 56 slidably disposed in a latch housing 58. The latch 56 may be a cylindrical bolt type latch having a tapered end 58. The latch 56 moves longitudinally along its axis within the latch housing 58 between a locked position in which the latch 56 is extended beyond a faceplate 60 of the latch housing 58 and an unlocked position in which the latch 56 is retracted towards the faceplate 60 and is even with the face plate 60 or just slightly extending beyond the faceplate 60.

The lid 38 has a strike plate 39 attached to the inside of the lid 38 (see FIG. 2). The strike plate 39 and latch 56 are positioned and configured so that when the lid 38 is in the closed position, the latch 56 in the locked position (extended away from the face plate 60) engages the strike plate 39 and the latch 56 inserts through an opening in the strike plate 39, thereby locking the lid 38 in the closed position. When the latch 56 is in this locked position, the locking mechanism 50 is in the "locked state" of the locking mechanism 50. The tapered end 58 of the latch 56 allows the strike plate 39 to properly engage the latch 56 when moving the lid 38 and strike plate 39 are moved from the open position to the closed position with the latch 56 in the locked position. As the lid 38 is moved to the closed position, the strike plate 39 hits the tapered end 58 of the latch 56 causing the latch 56 to retract thereby allowing the strike plate 39 and lid 38 to move to the closed position. A spring 62 biases the latch 56 back to the locked position after the leading edge of the strike plate 39 passes latch 56 and the opening in the strike plate 39 is aligned with the latch 56.

The strike plate 39 and latch 56 are also positioned and configured so that when the lid 38 is in the closed position and the latch 56 is in the unlocked position (i.e. retracted toward the faceplate 60), the latch 56 does not engage the strike plate 39 allowing the lid 38 to be moved from the closed position to the open position. When the latch 56 is in this unlocked position, the locking mechanism 50 is in the "unlocked state" of the locking mechanism 50.

The actuation device 54 is operably coupled to the latch 56 and is configured to move the latch 56 between the locked position and the unlocked position, as controlled by the controller 55. The actuation device 54 in the embodiment of FIGS. 3-6 includes an electric solenoid actuator 64 and the biasing spring 62, but may be any suitable actuation device which can move the latch 56 between the locked position and the unlocked position. The solenoid actuator 64 may be coupled to the latch 56 through a lever linkage to increase the force applied by the solenoid actuator 64 on the latch 56. The actuation device 54 moves the latch 56 longitudinally between the locked position and the unlocked position, in response to an electrical signal from the controller 55.

In the embodiment of FIGS. 3-6 with the electric solenoid actuator 64, when the controller 55 determines to adjust the locking mechanism 50 from the locked state to the unlocked state, the controller 55 energizes the solenoid actuator 64 and the solenoid actuator 64 moves the latch 56 from the locked position to the unlocked position, against the force of the biasing spring 62 which further compresses the spring 62. When the controller 55 determines to adjust the locking mechanism from the unlocked state to the locked state, the controller 55 de-energizes the solenoid actuator 64 and the solenoid actuator moves the latch 56 from the unlocked position to the locked position, with the biasing spring 62 also pushing the latch 56 to the locked position.

The controller 55 is operably coupled to the actuation device 50 and is configured to control the operation of the actuation device 54, and thus control the locking mechanism 50. The controller 55 comprises a printed circuit board 65 having a number of electrical components, including a programmable processor 66. The controller 55 may be operably coupled to the actuation device 50 by a electrical wires or other suitable electrical conductors. The controller 55 is also electrically connected to a power source such as the battery pack 68 for powering the controller 55. Other power sources may be utilized, for example, AC power or photovoltaic cells, or a combination thereof.

The controller 55 may also be include a code-operated device 70, such as the code keypad 70 shown in the embodiments. It should be understood that any code-operated device may be utilized in place of the code keypad 70, such as a biometric device, mechanical combination lock, a biometric lock, a remote activated lock (e.g. activated through WiFi, cellular communications, Near Field Communication (NFC), etc.), or other suitable device, that is configured to provide a signal to controller 55 that a security code has been provided to operate the controller 55, as described in more detail below. The code-operated device 70 and controller are programmed and configured to adjust the locking mechanism to the unlocked state when the security code is input into the code-operated device. For example, when a user enters to correct security code into the keypad 70, the controller 55 operates the actuation device 54 to move the latch 56 into the unlocked position which adjusts the locking mechanism into the unlocked state.

In one particular embodiment, the controller 55 may be programmed to operate as follows. A user enters the security code into the keypad 70 one digit at a time. The controller 55 or keypad 70 may have a beeper device (e.g. speaker or piezoelectric sound component) and be configured to provide an audible beep after each digit is entered. The security code may be followed by the "#" sign to indicate the end of the security code. If the code entered is not the correct security code, the red LED light 71 on the keypad may flash (e.g. flashes 3 times) and/or the beeper may beep (e.g. 3 beeps) to indicate the an error in entering the security code. If the correct security code is entered, the green LED light 73 may flash once or remain lit for a predetermined period of time, and/or the beeper may beep (e.g. 1 beep) to indicate that the correct security code has been entered. Then, the controller 55 operates the actuation device 54 to move the latch 56 into the unlocked position which adjusts the locking mechanism 50 into the unlocked state.

The controller 55 is programmed and configured for entering a programming mode in order to change the security code, set the operating mode (as described below), and/or modify other operating parameters of the receptacle 10, as desired. In one particular embodiment, the programming mode may be entered by pressing a programming button 75, which may be placed in a secure location such as a utility compartment 78 within the receptacle 10 such that it can only be accessed using a physical key, as described in more detail below. Upon pressing the programming button 75, the controller 55 enters a programming mode. The user then may enter a new security code, followed by the "#" sign to indicate the end of the entry of the new security code. The green light 73 may give a re-enter code signal (e.g. one flash) and/or the beeper may give a audible re-enter code signal (e.g. one beep) to prompt the user to re-enter the new security code as confirmation it was entered correctly. If both entries of the new security code match, the green light may flash a code accepted signal (e.g. 3 flashes) and/or the beeper may beep a code accepted signal (e.g. 3 beeps) to indicate that the new security code has been successfully programmed. If an incorrect or unacceptable code is entered, then the red light 71 and/or green light 73 may give an error signal and/or the beeper may give an error signal, prompting the user to re-start the process to enter the new security code.

The controller 55 and locking mechanism may also be programmed and configured to operate the actuation device 54 in various operating modes. The delivery receptacle 10 is configured to operate in at least one of several possible operating modes, in which the operating modes are at least partly determined by the configuration of the locking mechanism 50 and/or by the controller 55. The operation of the locking mechanism in any particular operating mode may also be affected by the status of a key lock mechanism, but that will be described separately below.

In a first mode, also referred to herein as a "single-delivery mode," the locking mechanism is set in the unlocked state. This may be done by entering the code into the code-operated device 70. Upon receiving the code, the code-operated device 70 signals the controller 55 to adjust the locking mechanism 50 to the unlocked state. The controller 55 operates the actuation device 54 to move the latch 56 to the unlocked position.

In the solenoid actuator embodiment, the controller 55 energizes the solenoid actuator, as described above. To avoid having to keep the solenoid actuator energized to keep the latch 56 in the unlocked position against the force of the biasing spring 62, a movable latch retention button 72 is provided. The latch retention button 72 comprises a rod having a proximal end which extends to the outside of the receptacle 10 so that it is accessible on the outside of the receptacle 10 and a distal end which extends into the locking mechanism 50. In the embodiment of FIGS. 3-6, the latch retention button 72 extends through a hole in the keypad 70 (code-operated device 70). The latch retention button 72 is slidably movable between a pushed out position (deactivated state) in which it is outward in the direction out of the receptacle 10 and a pushed in position (activated state) in which it is inward in the opposite direction. The retention button 72 also has a retention button spring (not shown) which biases the button 72 toward the pushed out position and a magnet on the distal end of the rod configured to engage the strike plate 39 when the button 72 is pushed in. When the latch retention button 72 is pushed in to the pushed in position, the distal end of the rod engages a latch slider 77. The latch slider 77 is coupled to the latch 56 and moves substantially parallel and in concert with the latch 56 between the unlocked position and the locked position, such that when the latch slider 77 is retained in the unlocked position, the latch 56 is also retained in the unlocked position, and similarly for the locked position. The latch slider 77 comprises a plate having a hole 79 for receiving the distal end of the rod when the latch 56 and latch slider 77 are in the unlocked position. When the button 72 is in the pushed in position, the magnet engages the strike plate 39 and retains the button 72 in the pushed in position against the force of the button spring.

Proceeding with the description of the first mode, with the lid 38 in the closed position and the strike plate 39 engaging the latch 56, the controller 55 energizes the solenoid actuator 64 and the latch 56 and latch slider 77 move to the unlocked position. The user then pushes the latch retention button 72 in to the pushed in position such that it engages the latch slider 77 by having the distal end of the rod extend into the hole 79 in the latch slider 77, which retains the latch slider 77 and latch 56 in the unlocked position. The magnet engages the strike plate 39 thereby retaining the button 72 in the pushed in position.

The controller 55 then de-energizes the solenoid actuator 64. The controller 55 may be programmed to de-energize the solenoid actuator 64 upon the elapse of a certain amount of time after actuating the solenoid, such as 3 second, 5 seconds, 10 seconds, or upon detecting that the latch retention button 72 has been activated, or upon some other event such as the user pushing a key on the keypad. With the solenoid de-energized, the locking mechanism 50 is retained in the unlocked state by the latch retention button 72.

When the lid 38 is opened, for example when someone is making a delivery and is opening the lid 38 to insert a delivery, the strike plate 39 slides along the magnet until the magnet disengages from the strike plate 39 releasing the latch retention button 72. The button spring forces the latch retention button 72 to the pushed out position disengaging the button 72 from the latch slider 77. The spring 62 forces the latch 56 and latch slider 77 to the locked position, thereby adjusting the locking mechanism 50 to the locked state. Upon closing the lid 38, for example after the delivery is inserted into the storage area 26, the lid 38 is locked in the closed position.

Thereafter, in order to open the lid 38, the security code must be entered into the code-operated device 70 to cause the controller 55 to energize the solenoid actuator 64 to adjust the locking mechanism 50 to the unlocked state as described above, or by using the key to adjust the key lock 90 to the unlocked position, as described below. Accordingly, the first mode, or single delivery mode, allows a very simple method of allowing a single delivery to the receptacle 10 without needing to give the security code to the delivery person. Moreover, multiple deliveries may delivered to the receptacle 10 in the first mode by providing the security code to each delivery person making a delivery after the first delivery.

A sub-mode of the first mode, which requires that each delivery person enters the security code to make a delivery to the receptacle 10, may be accomplished simply by not entering the security code to adjust the locking mechanism 50 to the unlocked state and initially leaving the locking mechanism 50 in the locked state. In this sub-mode of the first mode, in order to receive a delivery to the receptacle 10, the security code must be given to each delivery person in order to open the lid 38 to insert the delivery, even for the first delivery.

In a second mode, also referred to as "always locked mode," the locking mechanism 50 is left in the locked state and the locking mechanism cannot be adjusted to the unlocked state by entering the security code. In the solenoid embodiment of FIGS. 3-6, the receptacle 10 may be set in the second mode by closing the lid 38 and adjusting the key lock 90 to the forced locked position as described below. Alternatively, the receptacle 10 may be set in the second mode by configuring the controller 55 and/or code-operated device 70 to be adjustable to a second mode in which the controller 55 and/or code-operated device are configured to prevent the controller 55 from adjusting the locking mechanism 50 from the locked state to the unlocked state, even if the security code is entered into code-operated device 70.

In a third mode, the locking mechanism is set in the unlocked state allowing the lid 38 is opened and closed and opened again, without entering the security code into the code-operated device 70. The third mode might be desirable when the user wants to receive multiple deliveries without providing the delivery persons with the security code. In the solenoid embodiment of FIGS. 3-6, this mode may be set by providing a mechanism to retain the latch slider 77 in the unlocked position, such as adjusting the key lock 90 to a key unlocked position, as described below, or by providing a device to keep the latch retention button in the activated position even when the lid 30 is opened, or by providing another retainer similar to the latch retention button 72 to by engaging the latch 56 and/or latch slider 77 in the unlocked position even when the lid is open and closed multiple times.

The delivery receptacle 10 may also have a key lock 90 which is disposed on and extends through the front panel 22 of the housing 12. The key lock 90 includes a key hole 92, a key cylinder 94 having the key hole 92 for receiving a key, such as a typical key having a blade with bittings (teeth and notches) for unlocking the key cylinder 94 and allowing it to rotate. The front of the key lock 90 extends out of the housing 12 making it accessible from the outside of the housing 12, and the rear of the key lock extends into the interior of the housing 12. The key lock 90 has a latch cam 98 disposed in the interior of the housing 12 adjacent or near the rear end of the key lock. The latch cam 98 is coupled to the key cylinder 94 such that it rotates along with the rotation of the key cylinder 94. The latch cam 98 is configured such that rotating a key in the key cylinder 94 thereby also rotating the latch cam 98 moves the latch cam 98 between a stand-by position 100 (12 o'clock position; also referred to as a key locked position) in which the latch cam 98 does not engage the latch slider 77 (and therefore does not affect the locking mechanism 50) and a key unlocked position 102 (3' o'clock position in view of FIG. 3) in which the latch cam 98 bears on an edge of the latch slider 77 (i.e. engages the latch slider) and moves the latch slider 77 and latch 56 to the unlocked position thereby adjusting the locking mechanism 50 to the unlocked state.

The key lock 90 may also have a forced locked position 104 (9 o'clock position in view of FIG. 3; also referred to as "always locked mode") in which a locking cam 106 engages the latch slider 77, such as engaging a slot in the latch slider 77. The locking cam 106 retains the latch slider 77 and latch 56 in the locked position, preventing subsequent movement of the latch slider 77 and latch 56 even if the code is entered into the code-operated device 70 and/or the actuation mechanism 54 is activated (such as activating the solenoid actuator 64), and thereby retaining the locking mechanism in the locked state.

Referring to the operating modes above, the key lock 90 is in the stand-by position 100 (also called the key locked position) in the first mode; the key lock 90 is in the forced lock position 104 in the second mode; and the key lock 90 is in the key unlocked position 102 in the third mode.

To facilitate the movement of the key lock 90 to the forced locked position 104, the embodiment of FIGS. 3-6 may also have a latch retention button retractor 108. The latch retention button retractor 108 may be any suitable mechanism for moving the latch retention button 72 from the pushed in position (activated) to the pushed out position (deactivated). For instance, as illustrated in the embodiment of FIGS. 3-6, the latch retention button retractor 108 is a fairly large, slidable plate having several holes for engaging and accommodating the other components, including the latch retention button 72, the latch cam 98 and the key lock 100. As the key and latch cam 98 are rotated from the stand-by position to the forced locked position, the latch cam 98 also pushes the latch retention button retractor 108 to the right (as viewed from the back of the locking mechanism 50 of FIG. 5). If the latch retention button 72 is in the pushed in position (activated state) and retained by the magnet engaging the strike plate 39, a wedged surface on the latch retention button retractor 108 pushes against a mating wedged surface on the rod of the latch retention button thereby disengaging the magnet from the strike plate 39, and allowing the button 72 to move to the pushed out position (deactivated state). Once the button 72 moves to the pushed out position, the latch slider 77 and latch 56 move to the locked position. As the key is turned completely to the forced locked position, the locking cam 106 engages the latch slider 77, retaining them in the locked position. In the locked position of the latch retention button retractor 108 and latch slider 77, the latch retention button cannot be moved to the pushed in position because it is blocked by the latch retention button retractor 108 and/or the latch slider 77. Alternatively, if a spring loaded lever is used for the latch retention device, a linkage between the lever and a lock cam be used instead of the sliding wedge design of the latch retention button retractor 108.

Figure 10:
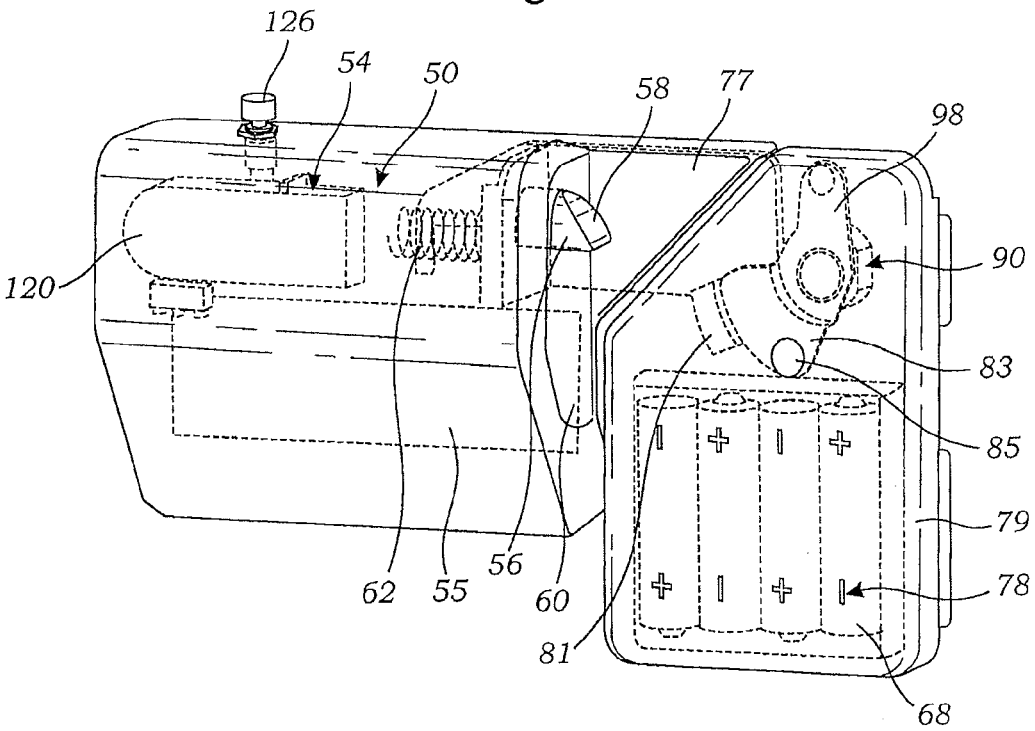
FIG. 10 is an enlarged rear view of an alternative locking mechanism, key lock, utility compartment and other components of FIG. 9 with the utility cover installed.

The delivery receptacle 10 may also have a utility compartment 78 within the interior of the housing 12, as best shown in FIG. 6. The utility compartment has a moveable cover 87 which can be opened to access the programming button 75 and power source 68 located within the utility compartment 78. The cover 87 may be attached to the utility compartment using hinges so that it swings between a closed position and open position. A cover latch 81 is provided on the interior of the cover 87 and is configured to engage a cover locking cam 83. The cover locking cam 83 is coupled, or part of, the key lock 90, such that the cover locking cam 83 rotates with the key and key cylinder 92. The cover locking cam 83 and cover latch 81 are configured such that when the key lock 90 is in the key locked position or the forced locked position, the cover locking cam 83 engages the cover latch 81 thereby locking the cover 87 in the closed position; and when the key lock is in the key unlocked position, the cover locking cam 83 is disengaged from the latch 81 allowing the cover 87 to be opened. The cover 87 may also have a programming button access hole 85 to allow the programming button 75 to be pressed without having to open the cover 87. The programming button 75 is made secure by positioning and configuring the button 75, the access hole 85, and the cover locking cam 83 such that the holes align to provide access to the button 75 only when the key lock 90 is in the key unlocked position. FIG. 6 shows the components in the key unlocked position with the cover locking cam 83 disengaged from the cover latch 81, and the programming button 75 accessible. FIG. 10, shows the components in the key locked position with the cover locking cam 83 engaged with the cover latch 81, and the programming button 75 blocked. Therefore, only the possessor of the key can reprogram the controller 55.

Turning now to FIGS. 7-11, a second embodiment of the delivery receptacle 10 is shown. The delivery receptacle 10 of FIGS. 7-11 is very similar to the delivery receptacle 10 of FIGS. 1-6, except that the embodiment of FIGS. 7-11 is configured for an actuation mechanism 54 comprising an electric motor 120, instead of the solenoid actuator 64 as in the first embodiment of FIGS. 1-6. Accordingly, the description above for elements in FIGS. 1-6 having like reference numerals to the elements in FIGS. 7-11 applies equally to both embodiments, except where differences are shown in the drawings or explained below. In addition, the second embodiment functions similarly to the first embodiment, except as differences are described below.

Figure 11:
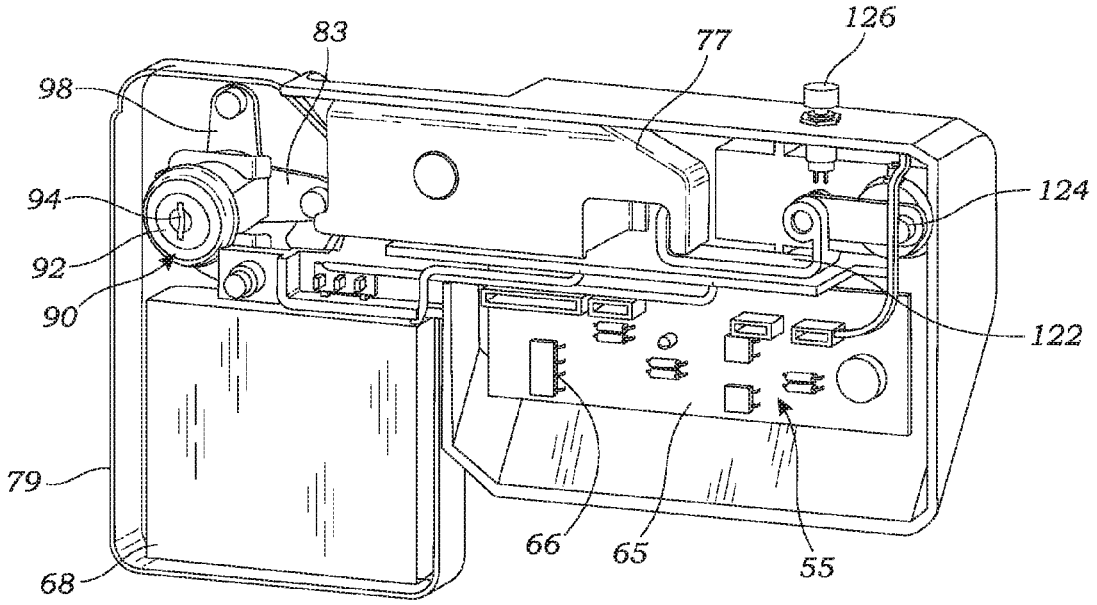
FIG. 11 is an enlarged front view of an the alternative locking mechanism, key lock, utility compartment and other components of FIG. 9.

Referring first to FIGS. 10-11, it can be seen that the locking mechanism in the second embodiment is somewhat simplified. Because the locking mechanism 50 of the second embodiment utilizes an electric motor 120 which can be configured to retain its position without being constantly powered, it does not need the latch retention button 72, latch retention button retractor 108 or related components. The locking mechanism 50 has an electric motor 120 which is coupled to the latch slider 77 using a motor linkage 122. A motor pin 124 couples the motor linkage 122 to the electric motor 120, and the motor linkage 122 couples to the latch slider 77 via mating bearing surfaces. The motor linkage 122 is configured such that when the electric motor 120 is activated by the controller 55 to adjust the latch 56 and latch slider 77 from the unlocked position to the locked position, the motor rotates and moves the motor pin 124 to the unlocked position (3 o'clock position in view of FIG. 11), which moves the motor linkage 122 such that it pulls the latch slider 77 and latch 56 from the locked position to the unlocked position. In the view of FIG. 11, the motor pin 124, motor linkage 122 and latch slider 77 are shown in the unlocked position (i.e. to the right as viewed from the back according to the perspective of FIG. 11). The friction and inertia of the motor 120 prevent the latch slider 77 and latch 56 from being forced back to the locked position by the force of the biasing spring 62. The motor 120 may have reduction gear(s) to the motor pin plate, which help keep the motor 120 from turning and the latch slider 77 and latch 56 from moving against the force of the biasing spring 62.

The motor linkage 122 is also configured such that when the electric motor 120 is activated by the controller 55 to adjust the latch 56 and latch slider 77 from the unlocked position to the locked position, the motor rotates and moves the motor pin 124 to the locked position (9 o'clock position in view of FIG. 11) which moves the motor linkage 122 such that it allows the latch slider 77 and latch 56 to be moved by the force of the biasing spring 62 from the unlocked position to the locked position. The innovative configuration of the motor 120, motor pin 124, motor linkage 122 and latch slider 77 allow the motor 120 to move the latch slider 77 and latch 56 between the unlocked position and locked position by activating and rotating the motor 120 in just a single direction (e.g. clockwise or counterclockwise), which may simplify the electronics and control of the receptacle 10.

The design of the mating bearing surfaces of the motor linkage 122 and latch slider 77 allow the latch slider 77 and latch 56 to be moved to the unlocked position by the force of the strike plate 39 hitting the tapered end 58 of the latch 56 to allow the lid 38 to be moved from the open position to the closed position and locked in the closed position, even with the motor pin 124 and motor linkage 122 in the locked position.

The second embodiment also has a lid position sensor 126 which detects when the lid 38 is open and/or closed. The lid position sensor 126 may be a simple open/closed switch which is located where the switch is depressed when the lid 38 is in the closed position and the switch is released when the lid 38 is in the open position. Alternatively, the lid position sensor can be a light sensor, magnetic sensor, or other suitable sensor for detecting whether the lid 38 is open or closed.

The second embodiment also has a mode switch 128 for selecting the operating mode for the receptacle 10, as described in more detail below. The mode switch 128 is operably coupled to the controller 55, and may be located within the utility compartment 78 so that access is restricted to someone having the key to move the key lock 90 and cover locking cam 83 to the unlocked position to open the cover 87. For example, the mode switch may be a three position switch to allow selection of one of the three operating modes for the receptacle, as described below.

Alternatively, the controller 55 and code-operated device 70 may be configured to be programmable to select the operating mode for the second embodiment, such that the operating mode may be selected by inputting the selection into the code-operated device 70. For example, a user may enter the programming mode by pushing the programming button 75, or by entering the security code into the code-operated device, and then enter an instruction to go into a mode selection process. The user then enters a code for the desired mode, such as 1, 2 or 3, for the first mode, second mode and third mode, respectively. The selection may be confirmed by a suitable entry, and then the green LED light 73 may flash (e.g. 3 flashes) and the beeper may beep (e.g. 3 beeps) to indicate the selection was successful, or the red LED light 71 may flash and the beeper may beep (e.g. 1 beep) to indicate the selection was not successful (in which case the user would have to repeat the process).

The key lock 90 of the second embodiment operates substantially the same as the key lock 90 in the first embodiment.

The configuration and method for programming for the second embodiment using the programming button 75 is also the same as the programming for the first embodiment.

The second embodiment also has a lock state indicator 132 which indicates whether the locking mechanism 50 is in the locked state or the unlocked state. The lock state indicator 132 is mechanically coupled to the latch slider 77 and/or the latch 56 such that the lock state indicator 132 will provide an indication whether the locking mechanism is in the locked state or unlocked state. For example, the lock state indicator 132 may be in an "out" position (e.g. showing a red flag indicator) when the locking mechanism 50 is in the locked state; and the lock state indicator 132 may be in an "in" position (concealing red flag) when the locking mechanism 50 is in the unlocked position. This lock state indicator 132 is helpful when using the operating modes, as described below.

The second embodiment also operates in any of at least several different operating modes, similar to the first embodiment, except that the operating mode may be set by setting the mode switch 128 (or otherwise selecting the mode, such as using the code-operated device 70) and/or be adjusting the key lock 90, and does not require the use of a latch retention mechanism. For instance, the mode switch 128 may be a three position switch, such as left for the first mode, middle for the second mode, and right for the third mode.

In a first mode, also referred to herein as a "single-delivery mode," the receptacle operating mode is set to the first mode, such as by setting the mode switch 128 to the first mode, such as the left position of a three position switch. Although the description of setting the operating mode will be described for an embodiment having a mode switch 128, it is understood that the controller 50 may be set by any of the methods and devices described above, or any other suitable method. Also, the key lock 90 is set to the key locked position such that the key lock 90 does not affect the locking mechanism, as described above. Setting the operating mode to the first mode configures the controller 55 to allow the locking mechanism 50 be adjusted to the unlocked state by entering the security code into the code-operated device 70. With the lid 38 in the closed position, the user enters the security code into the code-operated device 70. The LED light and beeper signals described above may also be utilized for this process, as described above for setting the first mode for the first embodiment. Upon receiving the code, the code-operated device 70 signals the controller 55 to adjust the locking mechanism 50 to the unlocked state. The controller 55 operates the actuation device 54 to move the latch 56 to the unlocked position. In the second embodiment, the controller 55 operates the electric motor 120 to position the motor pin 124 to the unlocked position, which moves the motor linkage 122, latch slider 77 and latch 56 to the unlocked position. The lid 38 is now unlocked for a delivery to be made. The lock state indicator 132 is in the "in" position with the red flag hidden showing that the locking mechanism 50 is in the unlocked state and the lid 38 is unlocked.

When the lid 38 is opened, for example when someone is making a delivery and is opening the lid 38 to insert a delivery, the lid sensor 126 detects that the lid 38 has been opened and signals the controller 55 that the lid 38 has been opened. In the first mode, upon receiving a signal from the lid sensor 126, the controller 55 is configured to adjust the locking mechanism 50 from the unlocked state to the closed state. Accordingly, the controller 55 operates the electric motor 120 to position the motor pin 124 to the locked position, which moves the motor linkage 122 to the unlocked position, allowing the biasing spring 62 to move the latch slider 77 and latch 56 to the locked position. The locking mechanism 50 is then in the locked state and when the lid 38 is closed, the lid 38 is locked in the closed position. The lock state indicator 132 is in the "out" position with the red flag visible showing that the locking mechanism 50 is in the locked state and indicating that the code must be entered or the key used to adjust the key lock 90 to the unlocked position in order open the closed and locked lid 38.

Alternatively, the controller 55 may be configured to adjust the locking mechanism 50 from the unlocked state to the locked state after the lid sensor 126 detects and signals the controller 55 that the lid 38 has been opened and then closed, such as opened to insert a delivery and then closed after the delivery has been inserted into the receptacle 10.

In another alternative, the lid sensor 126 may be replaced by, or supplemented with, a delivery sensor which detects the existence of a parcel in the storage area 26. Then, instead of, or in addition to, monitoring the lid sensor 126, the controller 55 monitors the delivery sensor and may be configured to adjust the locking mechanism 50 from the unlocked state to the locked state based on signals from the delivery sensor and/or the lid sensor 126. In addition, the delivery sensor can be operably coupled to a communication device which alerts the owner via a mobile device, such as a text message (SMS, MMS, etc.), an email, a phone call, or other suitable communication, or even a visual indicator on the receptacle 10 itself, that a delivery has been inserted into the receptacle 10.

Thereafter, in order to open the lid 38 to retrieve the deliveries (or to make additional deliveries), the security code must be entered into the code-operated device 70 to cause the controller 55 to activate the electric motor 120 to adjust the locking mechanism 50 to the unlocked state, as described above, or the key must be used to adjust the key lock 90 to the unlocked position. Accordingly, the first mode, or single delivery mode, allows a very simple method of allowing a single delivery to the receptacle 10 without needing to give the security code to the delivery person. Moreover, multiple deliveries may delivered to the second embodiment of the receptacle 10 in the first mode by providing the security code to each delivery person making a delivery after the first delivery.

A sub-mode of the first mode, which requires that each delivery person enters the security code to make a delivery to the receptacle 10, may be accomplished by configuring the controller 55 by setting the mode switch 128, and then simply by not entering the security code to adjust the locking mechanism 50 to the unlocked state and initially leaving the locking mechanism 50 in the locked state with the lid 38 locked in the closed position. Then, even for the first delivery, the delivery person must enter the security code in order to open the lid 38 to insert the delivery. After entering the security code and opening the lid 38 (or opening and closing the lid 38), the controller 55 adjusts the locking mechanism 55 to the locked state, and then when the lid 38 is closed, it will be locked closed, until the code is entered again for the next delivery or to retrieve the deliveries. In this sub-mode of the first mode, in order to receive a delivery to the receptacle 10, the security code must be given to each delivery person in order to open the lid 38 to insert the delivery, even for the first delivery.

In a second mode, referred to as the "always locked mode," the locking mechanism 50 is kept in the locked state, and cannot be adjusted from the locked state to the unlocked state using the code-operated device 70. In the second embodiment, the receptacle 10 can be set in the second mode by setting the mode switch 128 to the second mode, such as the middle position. Setting the operating mode to the second mode configures the controller 55 to set the locking mechanism 50 in the locked state by positioning the motor pin 124 in the locked position thereby setting the latch 56 and latch slider 77 in the locked position, and also configures the controller 55 and/or code-operated device to prevent the controller 55 from adjusting the locking mechanism 50 from the locked state to the unlocked state, even if the security code is entered into code-operated device 70. In the second mode, the locking mechanism 50 can only be adjusted to the unlocked state in order to open the locked lid 38 by using the key to adjust the key lock 90 to the unlocked position. Alternatively, it is also possible to set the receptacle 10 in this second mode by adjusting the key lock 90 to the forced locked position, if one is provided (the forced locked position is optional). In the second mode, the lock state indicator 132 is in the "out" position with the red flag visible showing that the locking mechanism 50 is in the locked state.

In a third mode, also referred to as an "always unlocked mode," the locking mechanism is set in the unlocked state allowing the lid 38 to be opened and closed and opened again, without entering the security code into the code-operated device 70. In the second embodiment, the receptacle 10 may be set in the third mode by setting the mode switch 128 to a third mode. Setting the operating mode to third mode configures the controller 55 to set the locking mechanism 50 in the unlocked state by positioning the motor pin 124 in the unlocked position thereby positioning the latch 56 and latch slider 77 in the unlocked position. Alternatively, it is also possible to set the receptacle 10 in this third mode by adjusting the key lock 90 to the key unlocked position.

Many delivery and courier services use devices to electronically confirm delivery of a parcel, such as a handheld device for accepting and recording a recipient's name and/or signature. The receptacle 10 may also be equipped with a delivery confirmation device such as a unique identifier for use by a delivery or courier service to electronically confirm delivery of a parcel or letter. The unique identifier can be provided on the receptacle 10 by etching, molding, name plate, sticker, LCD, or any other suitable means. This identifier can be scanned by the courier upon delivery to confirm that the parcel was delivered to the recipient's address and placed into the receptacle 10. The scanning of the identifier can be incorporated into the courier's parcel tracking system to alert the recipient that a parcel has been delivered and inserted into receptacle 10. An example of such a tracking system in the shipping industry which alerts the recipient to completed deliveries is UPS My Choice. All of the capabilities of the UPS My Choice program are incorporated by reference herein, and are within the scope of the present invention.

Many other features and concepts are also contemplated for the present invention. The receptacle 10 may be equipped with a method and system for communicating delivery details and the contents of the storage compartment 30. For instance, a WiFi or other wireless communication (e.g. cellular phone communication) enabled camera may be utilized to provide images of the contents of the storage compartment 30 after a delivery has been made. The wireless enabled camera is configured to transmit the images to the owner of the receptacle electronically, such as via the internet or other communication network, an SMS message, an email, or other suitable communication. The camera and transmission of images may be activated by the detection of a delivery to the receptacle, or by the delivery alert sent by the courier as described above.

Soft foam or other material can be placed at the bottom of the storage area 26 to cushion the fall of deliveries. The cushion can be "waffled" with through holes to allow water to drain through it.

A spring connecting the lid 38 and the housing 12 may be provided to assist in closing and/or opening the lid 38. A hinged linkage can be configured such that the spring begins to assist in closing the roof only near the limit of travel, so it feels to the user as if it takes over the work of closing and keeping the roof closed, and also assisting the user in fully latching the roof.

A spring loaded or adjustable main floor may be provided to allow the user to manually adjust the capacity of the storage area 26. A similar main adjustable main floor may be provided that automatically raises or lowers the floor depending on the weight of the contents, thereby reducing the falling distance of deliveries.

A sensor device that measures the height of the deliveries in the storage compartment may be coupled to the controller 55 and the controller may be configured to automatically lock the lid 38 in the closed position, even if the security code is entered, so no further deliveries can be made when the compartment is full.

The receptacle 10 may also be provided with a slot in the front wall 22 and/or in the lid 38 to allow delivery of a letter, priority document envelope, or similar article, without opening the delivery door 38. This can be useful because it allows delivery of smaller, thin items, even if the storage compartment is full of large parcels. A separate storage compartment may even be provided adjacent the slot for storing deliveries inserted through the slot.

Alternative lock interfaces for the access cover 87 may be utilized, such as a mechanical combo lock, remote activation lock through WiFi, or a thumb print or other biometric lock.

The receptacle 10 may also have an electrical connection to a home alarm system, so that the receptacle 10 can be monitored for theft or tampering. One or more alarm sensors may be placed in and around the receptacle 10, and connected to the home alarm system.

The storage area 26 may be provided with multiple compartments, and/or with various sizes and shapes for different types of deliveries.

Weather stripping may be provided around the delivery door 38, access door 87, and/or around the seams of the housing 12 to inhibit water from entering the housing.

Furthermore, the receptacle 10 may include one or more additional accessories and options to provide additional functionality and/or enhance the receptacle 10. Any one or more of the following accessories and option may be attached to, affixed on, or connected to the housing 12 of the receptacle:

1) Hooks, such as coat hooks for visitors;
2) Umbrella holder;
3) Separate additional locked or unlocked storage compartment for personal use;
4) Thermometer or other weather measuring devices;
5) Decorative items to adorn the receptacle 10, such as a planter, themed magnets, themed toppers, Halloween candy tray;
6) Welcome sign;
7) Address plaque;
8) Message chalkboard, pad or clip;
9) Lighting on the outside and/or walkway lighting, powered by solar, battery or AC power;
10) Lighting on the inside to aid in retrieving contents, powered by solar, battery or AC power;
11) Personalized Monogram;
12) Pet water and food dispenser attached to the bottom;
13) Hose reel;
14) Shoe scraper;
15) Cat bed, preferably on roof;
16) Bird feeder or bird house, preferably on the roof;
17) Flag pole attachment;
18) Ash tray for disposing of cigarettes before entering home;
19) Magazine or newspaper holder;
20) Hide-a-key
21) LCD screen or other electronic display connected to broadcast and/or CCTV signal, and configured to show programming and/or advertising to passersby, similar to the system used in elevators, at gas station pumps, etc. This feature would be most useful in a secure and populated environment, such as a hotel, lobby, post office, college dorm, etc.

Although particular embodiments have been shown and described, it is to be understood that the above description is not intended to limit the scope of these embodiments. While embodiments and variations of the many aspects of the invention have been disclosed and described herein, such disclosure is provided for purposes of explanation and illustration only. Thus, various changes and modifications may be made without departing from the scope of the claims. For example, not all of the components described in the embodiments are necessary, and the invention may include any suitable combinations of the described components, and the general shapes and relative sizes of the components of the invention may be modified. Accordingly, embodiments are intended to exemplify alternatives, modifications, and equivalents that may fall within the scope of the claims. The invention, therefore, should not be limited, except to the following claims, and their equivalents.

What is claimed is:

1. A delivery receptacle for receiving and securing an object, comprising:

a housing having an input opening and a storage area adjoining the input opening;

a lid hingedly attached to the housing allowing the lid to be moved between a closed position in which the lid covers the input opening and an open position in which the lid is substantially completely out of the way of the input opening allowing access the storage area through the input opening;

a locking mechanism having a latch, an actuation device operably coupled to the latch and a controller operably coupled to the actuation device and configured to control the actuation device, the locking mechanism having a locked state in which the actuation device positions the latch in a locked position to lock the lid when the lid is in the closed position and an unlocked state in which the actuation device positions the latch in an unlocked position allowing the lid to be moved from the closed position to the open position, the controller including a code-operated device configured to receive a code which causes the controller to adjust the locking mechanism from the locked state to the unlocked state; and wherein the locking mechanism is configured to have at least two of the following three operating modes, including:

a first mode in which the locking mechanism is in the unlocked state with the lid in the closed position thereby allowing the lid to be opened, and upon one of (i) opening the lid or (ii) opening and closing the lid, the controller adjusts the locking mechanism from the unlocked state to the locked state such that when the lid is closed the lid is locked in the closed position, and thereafter, entering the code into the code-operated device causes the controller to adjust the locking mechanism from the locked state to the unlocked state allowing the lid to be re-opened;

a second mode in which the locking mechanism is in the locked state and the locking mechanism cannot be adjusted from the locked state to the unlocked state by entering the code into the code-operated device; and a third mode in which the controller adjusts the locking mechanism into the unlocked state, and the lid can be opened and closed and opened again without entering the code into the code-operated device;

a utility compartment within the housing in which at least one of a mode switch for selecting one of the three operating modes, a programming button for putting the controller into a programming mode, and a battery is located within the utility compartment, the utility compartment having an access door;

a key lock disposed in the housing, the key lock configured to be operated by a key and having a latch mechanism such that rotating a key in the key lock rotates the key lock and latch mechanism between a key locked position in which the latch mechanism does not affect the locking mechanism and a key unlocked position in which the latch mechanism adjusts the locking mechanism to the unlocked position, the key lock having a door locking device which is rotated by rotating a key in the key lock, and wherein when the key lock is in the key locked position the door locking device is in a door locked position which locks the access door in a closed position preventing access into the utility compartment and when the key lock is in the key unlocked position the door locking device is in a door unlocked position which unlocks the access door allowing the door to be opened thereby allowing access into the utility compartment.

2. The delivery receptacle of claim 1, wherein in the key unlocked position the key lock allows access to at least one of the mode switch for selecting one of the three operating modes and the programming button for putting the controller into the programming mode, and in the key locked position the key lock prevents access to at least one of the mode switch for selecting one of the three operating modes and the programming button for putting the controller into a programming mode.

3. The delivery receptacle of claim 1, wherein the latch mechanism, in the key unlocked position, adjusts the locking mechanism to the unlocked state by forcing the latch to the unlocked position.

4. The delivery receptacle of claim 1, wherein the key lock and latch mechanism have a force locked position in which the latch mechanism adjusts the locking mechanism to the locked position and prevents the locking mechanism from being adjusted to the unlocked position by the controller.

5. The delivery receptacle of claim 1, further comprising:

a lid position sensor coupled to the controller and configured to signal the controller whether the lid is in the closed position or the open position.

6. The delivery receptacle of claim 1, wherein the actuation device comprises an electric motor mechanically coupled to the latch, and the motor is configured to move the latch between the locked position and the unlocked position in response to electrical signals controlled by the controller.

7. The delivery receptacle of claim 1, wherein the actuation device comprises an electric motor having a gear reducer, and the electric motor is coupled to the latch via a motor linkage such that rotation of the gear reduced output shaft of the motor moves the motor linkage thereby moving the latch between the locked position and the unlocked position.

8. The delivery receptacle of claim 1, wherein the actuation device comprises:

an electric solenoid actuator mechanically coupled to the latch, and the solenoid actuator is configured to move the latch from the locked position to the unlocked position in response to electrical signals controlled by the controller, and a spring coupled to the latch and configured to push the latch from the unlocked position to the locked position when the solenoid actuator is de-actuated.

9. The delivery receptacle of claim 8, further comprising:

a latch locking device configured for adjustment between a retaining position for retaining the latch in the unlocked position, and a release position in which the latch locking device releases the latch from the unlocked position allowing the latch to move to the locked position, and the delivery receptacle is configured such that opening the lid causes the latch locking device to adjust from the retaining position to the release position.

10. The delivery receptacle of claim 9, wherein the latch locking device comprises a push button configured to adjust the latch locking device into the retaining position upon pushing the push button.

11. A delivery receptacle for receiving and securing an object, comprising:

a housing having an input opening and a storage area adjoining the input opening;

a lid hingedly attached to the housing allowing the lid to be moved between a closed position in which the lid covers the input opening and an open position in which the lid is substantially completely out of the way of the input opening allowing access the storage area through the input opening;

a utility compartment within the housing in which at least one of a programming button for putting a controller into a programming mode, and a battery is located within the utility compartment, the utility compartment having an access door;

a locking mechanism having a latch, an actuation device operably coupled to the latch and the controller operably coupled to the actuation device and configured to control the actuation device, the locking mechanism having a locked state in which the actuation device positions the latch in a locked position to lock the lid when the lid is in the closed position and an unlocked state in which the actuation device positions the latch in an unlocked position allowing the lid to be moved from the closed position to the open position, the controller including a code-operated device configured to receive a code which causes the controller to adjust the locking mechanism from the locked state to the unlocked state;

wherein the locking mechanism is configured to operate in a first mode in which the locking mechanism is in the unlocked state with the lid in the closed position thereby allowing the lid to be opened, and upon one of (i) opening the lid or (ii) opening and closing the lid, the controller adjusts the locking mechanism from the unlocked state to the locked state such that when the lid is closed the lid is locked in the closed position, and thereafter, entering the code into the code-operated device causes the controller to adjust the locking mechanism from the locked state to the unlocked state allowing the lid to be re-opened; and a manually operated override lock disposed in the housing, the override lock configured to be operated manually and having a latch adjusting mechanism such that manually operating the lock adjusts the latch adjusting mechanism between an override locked position in which the latch adjusting mechanism does not affect the locking mechanism and an override unlocked position in which the latch adjusting mechanism adjusts the locking mechanism to the unlocked position, the override lock having a door locking device which is adjusted when the override lock is operated, and wherein when the override lock is in the override locked position the door locking device is in a door locked position which locks the access door in a closed position preventing access into the utility compartment and when the override lock is in the override unlocked position the door locking device is in a door unlocked position which unlocks the access door allowing the door to be opened thereby allowing access into the utility compartment.

12. The delivery receptacle of claim 11, wherein in the override unlocked position the override lock allows access to a programming button for putting the controller into a programming mode, and in the override locked position the override lock prevents access to the programming button for putting the controller into a programming mode.

13. The delivery receptacle of claim 12, wherein the latch adjusting mechanism, in the override unlocked position, adjusts the locking mechanism to the unlocked state by forcing the latch to the unlocked position.

14. The delivery receptacle of claim 11, further comprising:

a lid position sensor coupled to the controller and configured to signal the controller whether the lid is in the closed position or the open position.

15. The delivery receptacle of claim 11, wherein the actuation device comprises an electric motor mechanically coupled to the latch, and the motor is configured to move the latch between the locked position and the unlocked position in response to electrical signals controlled by the controller.

16. The delivery receptacle of claim 11, wherein the actuation device comprises an electric motor having a gear reducer, and the electric motor is coupled to the latch via a motor linkage such that rotation of the gear reduced output shaft of the motor moves the motor linkage thereby moving the latch between the locked position and the unlocked position.

17. The delivery receptacle of claim 11, wherein the actuation device comprises:

an electric solenoid actuator mechanically coupled to the latch, and the solenoid actuator is configured to move the latch from the locked position to the unlocked position in response to electrical signals controlled by the controller, and a spring coupled to the latch and configured to push the latch from the unlocked position to the locked position when the solenoid actuator is de-actuated.

18. A delivery receptacle for receiving and securing an object, comprising:

a housing having an input opening and a storage area adjoining the input opening;

a lid hingedly attached to the housing allowing the lid to be moved between a closed position in which the lid covers the input opening and an open position in which the lid is substantially completely out of the way of the input opening allowing access the storage area through the input opening;

a locking mechanism having a latch, an actuation device operably coupled to the latch and a controller operably coupled to the actuation device and configured to control the actuation device, the locking mechanism having a locked state in which the actuation device positions the latch in a locked position to lock the lid when the lid is in the closed position and an unlocked state in which the actuation device positions the latch in an unlocked position allowing the lid to be moved from the closed position to the open position, the controller including a code-operated device configured to receive a code which causes the controller to adjust the locking mechanism from the locked state to the unlocked state;

wherein the locking mechanism is configured to operate in a first mode in which the locking mechanism is in the unlocked state with the lid in the closed position thereby allowing the lid to be opened, and upon one of (i) opening the lid or (ii) opening and closing the lid, the controller adjusts the locking mechanism from the unlocked state to the locked state such that when the lid is closed the lid is locked in the closed position, and thereafter, entering the code into the code-operated device causes the controller to adjust the locking mechanism from the locked state to the unlocked state allowing the lid to be re-opened;

a utility compartment within the housing in which at least one of a mode switch for selecting one of three operating modes, a programming button for putting the controller into a programming mode, and a battery is located within the utility compartment, the utility compartment having an access door;

a key lock disposed in the housing, the key lock configured to be operated by a key and having a latch mechanism such that rotating a key in the key lock rotates the key lock and latch mechanism between a key locked position in which the latch mechanism does not affect the locking mechanism and a key unlocked position in which the latch mechanism adjusts the locking mechanism to the unlocked position, the key lock having a door locking device which is rotated by rotating a key in the key lock, and wherein when the key lock is in the key locked position the door locking device is in a door locked position which locks the access door in a closed position preventing access into the utility compartment and when the key lock is in the key unlocked position the door locking device is in a door unlocked position which unlocks the access door allowing the door to be opened thereby allowing access into the utility compartment; and a lid position sensor coupled to the controller and configured to signal the controller whether the lid is in the closed position or the open position.

19. The delivery receptacle of claim 18, wherein the actuation device comprises an electric motor mechanically coupled to the latch, and the motor is configured to move the latch between the locked position and the unlocked position in response to electrical signals controlled by the controller.

20. The delivery receptacle of claim 18, wherein the actuation device comprises an electric motor having a gear reducer, and the electric motor is coupled to the latch via a motor linkage such that rotation of the gear reduced output shaft of the motor moves the motor linkage thereby moving the latch between the locked position and the unlocked position.

21. The delivery receptacle of claim 18, wherein the actuation device comprises:

an electric solenoid actuator mechanically coupled to the latch, and the solenoid actuator is configured to move the latch from the locked position to the unlocked position in response to electrical signals controlled by the controller, and a spring coupled to the latch and configured to push the latch from the unlocked position to the locked position when the solenoid actuator is de-actuated.

* * * * *